US005535255A

United States Patent [19]

Gabbay

[11] Patent Number: 5,535,255

[45] Date of Patent: Jul. 9, 1996

[54] SYSTEM FOR THE COOLING OF AN ANODE FOR AN X-RAY TUBE IN A RADIOGENIC UNIT WITHOUT HEAT EXCHANGER

[75] Inventor: Emile Gabbay, Paris, France

[73] Assignee: GE Medical Systems S.A., Buc, France

[21] Appl. No.: 156,632

[22] Filed: Nov. 24, 1993

[30] Foreign Application Priority Data

Nov. 27, 1992 [FR] France ..... 92 14334

[51] Int. Cl.[6] ..... H01J 35/10

[52] U.S. Cl. ..... 378/200; 378/141

[58] Field of Search ..... 378/199–202, 378/141

[56] References Cited

U.S. PATENT DOCUMENTS

| | | | |
|---|---|---|---|
| 2,790,102 | 4/1957 | Atlee | 378/141 |
| 2,829,271 | 4/1958 | Boucher | 378/200 |
| 4,264,818 | 4/1981 | Petersen | 378/141 |
| 4,961,214 | 10/1990 | Van Endschot | 378/196 |

FOREIGN PATENT DOCUMENTS

| | | |
|---|---|---|
| 0034768 | 9/1981 | European Pat. Off. . |
| 0404335 | 12/1990 | European Pat. Off. . |
| 663114 | 11/1987 | Switzerland . |

*Primary Examiner*—Craig E. Church

*Attorney, Agent, or Firm*—Kerkam, Stowell, Kondracki & Clarke; Dennis P. Clarke

[57] ABSTRACT

A system for the cooling of a fixed anode for an X-ray tube placed in a radiogenic unit comprising a cooling fluid circuit that passes into the anode and extends along the surfaces of the mount that are adjacent to the radiogenic unit, such as the yoke bearing said unit. Application to single-pole and two-pole X-ray tubes.

4 Claims, 2 Drawing Sheets

SYSTEM FOR THE COOLING OF AN ANODE FOR AN X-RAY TUBE IN A RADIOGENIC UNIT WITHOUT HEAT EXCHANGER

BACKGROUND OF THE INVENTION

1. Field of the Invention

The present invention relates to a system for the cooling of an anode that can be used to increase the heat dissipation of an X-ray tube operating inside a radiogenic unit without using a heat exchanger comprising a heat-transfer fluid such as air or water placed under forced circulation.

2. Description of the Prior Art

An X-ray tube or radiogenic tube essentially comprises two electrodes, one cathode and one anode contained in a glass tube under vacuum and respectively fixed to the ends of this tube. The cathode is generally constituted by a tungsten filament, housed in a metal part With a shape that is suited for it to play the role of an electronic lens. This metal part shall be called a focusing part. It is designed to send an electron beam focused on the anode. This anode, in the case of rotating anode tubes, is often constituted by a massive disk made of graphite or molybdenum for example, generally covered on one face with a layer of tungsten. Naturally, for special applications, the materials of the anode may be other than those cited here above. The anode may also be constituted by a cylindrical mass made of copper that bears, on its face positioned before the cathode, a plate made of a refractory metal with a high atomic number. It is for the latter type of tube that the present invention is very promising.

When the filament of the cathode is made incandescent and the anode is taken to a positive potential of some volts with respect to the cathode, the electrons emitted by the cathode are accelerated towards the anode by the electrical field created between the two electrodes and bombard a surface of the anode called the focal spot of the X-radiation. This zone of impact of the electrons becomes the main source of X-ray emission throughout the space facing the anode, except at the glancing angles of incidence.

A small proportion of the energy expended to produce the X-ray beam is converted into X-rays while the rest is converted into heat that is stored in the anode. This heat results from the slowing down of the electrons that are emitted by the cathode and strike the anode. The heat is then transferred to the external environment by radiation in the case of a rotating anode tube and by conduction when the anode is fixed.

These X-ray tubes for which the anode is fixed are generally mounted in radiogenic units that furthermore comprise a high-voltage transformer and rectifier elements. The power dissipated by natural convection from the radiogenic unit, which receives all the heat from the anode before dissipating it, cannot permanently exceed 150 to 200 watts. When the anode has to dissipate a higher level of power, of the order of one to four kilowatts, the X-ray tube is placed no longer in the radiogenic unit but in a sheath provided with a water or air cooling system with forced convection, such as a radiator with a ventilator for example.

Such methods of cooling by forced convection have the drawback of requiring an inflow of water from a source, which is difficult when the X-ray tube is mobile around the patient to be radiographed. Or else they have the drawback of requiring the blowing of air in the room in which the radiography apparatus is placed: this room is generally a sterile room in which it is hardly acceptable to stir the air.

SUMMARY OF THE INVENTION

The present invention is aimed at resolving these drawbacks by proposing a system for the cooling of the anode by increasing the exchange surface area between the anode and the external environment. To this end, the object of the invention is a system for the cooling of an anode for an X-ray tube placed in a radiogenic unit with a metal wall, the fixed anode of this X-ray tube being made out of a copper block into which there is fitted a pellet made of a refractory material with a high atomic number, said cooling circuit comprising a fluid cooling circuit that passes into the anode and is extended along the surfaces of the mount that are adjacent to the radiogenic unit.

BRIEF DESCRIPTION OF THE DRAWINGS

Other features and advantages of the invention will appear from the following description of exemplary embodiments of an anode, illustrated by the appended drawings of which.

FIGS. $\mathbf{1}_a$ and $\mathbf{1}_b$ show a schematic view of a mobile radiography apparatus and a radiogenic unit according to the invention.

Figure 1A:
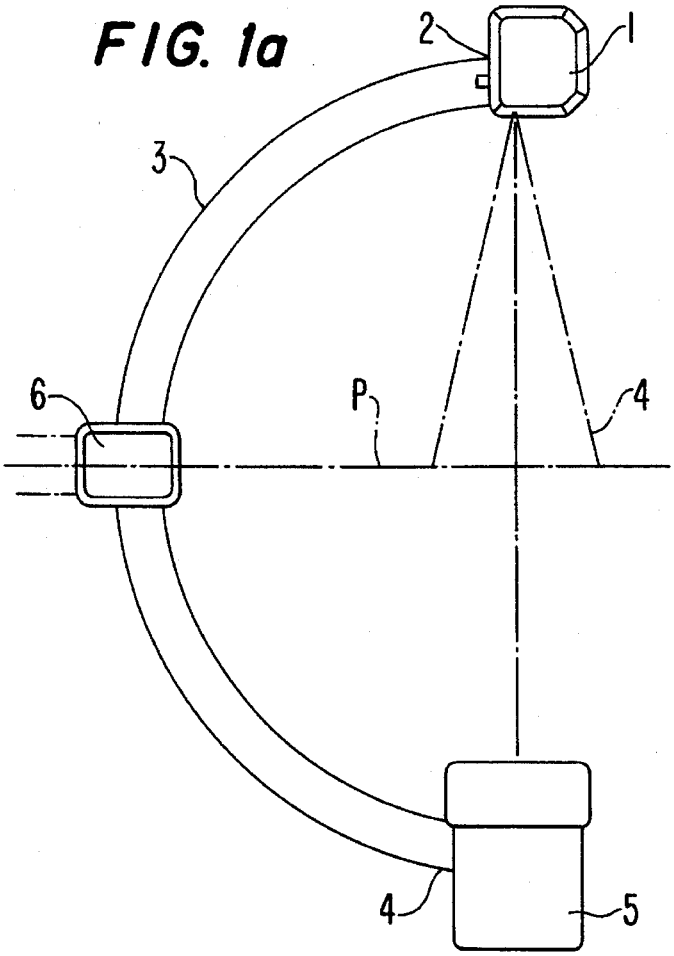
Figure 1B:
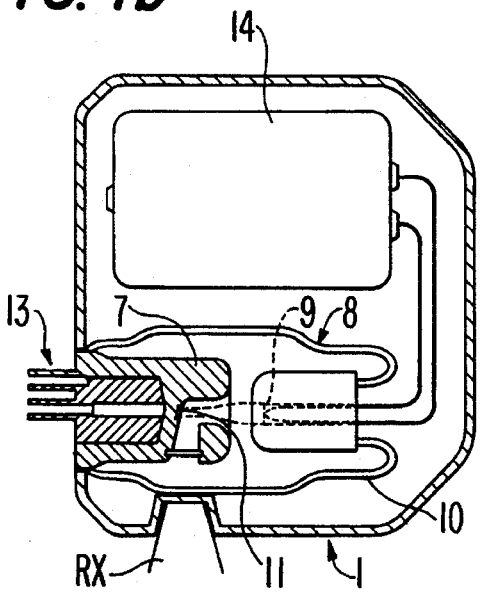

The elements bearing the same references in the different figures fulfil the same functions with a view to obtaining the same results.

MORE DETAILED DESCRIPTION

As can be seen in FIG. $\mathbf{1}_a$, which is a schematic view of a radiology apparatus that is mobile about a plane P in which the patient is placed, the radiogenic unit 1 containing the X-ray tube is mounted at one end 2 of a yoke 3 having the shape of an arc of a circle or a U, the other end 4 of this yoke supporting the image amplifier tube 5. This yoke 3 is provided with a pivot 6 at its middle, enabling it to rotate about the plane P.

FIG. $\mathbf{1}_b$ is a detailed sectional view of the radiogenic unit 1 of the radiology apparatus of FIG. $\mathbf{1}_a$. It has an X-ray tube 8 as well as a high-voltage transformer and rectifier elements 14. The tube 8 has a cathode 9 placed before the X-ray emissive pellet 11 of an anode 7 in a glass tube 10 under vacuum, and a cooling device 13.

Figure 2:
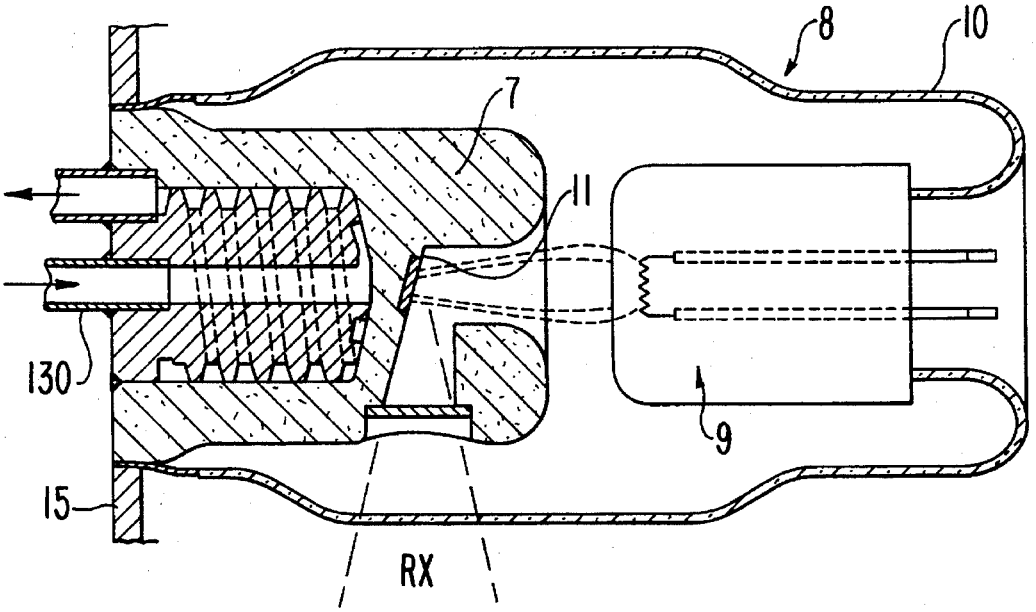
FIG. 2 shows a longitudinal sectional view of an X-ray tube comprising a system for cooling the anode according to the invention.

FIG. 2 is a longitudinal sectional view of an X-ray tube 8 that has its anode cooled according to the invention. This tube 8 has an anode 7, a cathode 9 fixed to one end of a glass tube 10 facing the anode 7 which is itself fixed to the other end. This anode 7 is made out of a cylindrical copper block covered with a layer 11 of a deposit of refractory metal with a high atomic number, on its face before the cathode. According to the invention, the copper block of the anode is fixedly joined to the wall 15 of the radiogenic unit.

During operation, the copper disk of the anode gets heated. In the prior art, air was blown or water was circulated through the thickness of the anode. The heat of this water was then transmitted to the wall of the radiogenic unit which, once heated, dissipated this heat by natural convection. The invention proposes a very substantial increase in the surface area of heat exchange by convection, by making a large part of the mount of the apparatus participate in the exchange. To this end, there is added a cooling circuit 130 that water or any other heat-exchange fluid, said circuit being constituted by several tubings fixedly joined to the different parts of the mount that are adjacent to the envelope of the tube, such as the yoke bearing the radiogenic unit, in order to heat them. According to the invention, the heat exchange surface is then constituted by the surface area of the radiogenic unit plus the surface area of the yoke.

Figure 3:
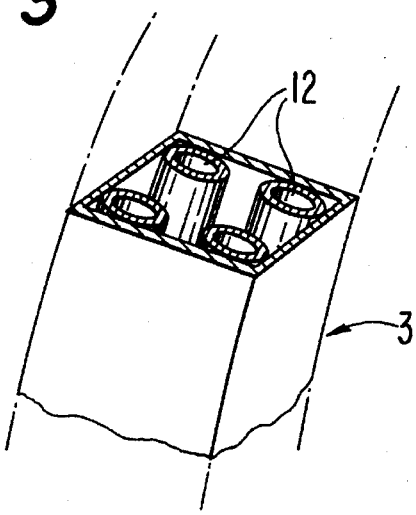
FIG. 3 shows a section of a yoke bearing the radiogenic unit cooled according to the invention.

FIG. 3 shows a section of the yoke 3 bearing the radiogenic unit. Four tubings 12 are soldered to the wall of the radiogenic unit, enabling the circulation of water designed for the cooling of the anode. The tubings are connected to the circuit of water passing into the anode. In the particular example of FIG. 3, the yoke 3 has a square section and the tubings 12 are soldared to the interior. Said tubings may be made of metal for example.

Through the invention, the thermal power to be dissipated may be in the range of five times the power that can be dissipated by the radiogenic unit alone.

According to another embodiment of the invention, the X-ray tube could be a two-pole X-ray tube, i.e. the anode would be connected to the positive high voltage, In this case, it would suffice to replace the water of the cooling system with insulating oil and to electrically insulate the anode of the wall from the radiogenic unit connected to the ground.

The value of the invention lies in the fact that all these previously described heat exchangers are replaced by those surfaces of the mount itself that are adjacent to the radiogenic unit by raising their temperatures.

The heat, which is dissipated by a heated body under natural convection, can be written according to the following equation:

$$W=h*S\ (T-To)$$

where h is the coefficient of heat exchange between the body and the external environment;

S is the exchange surface;

T is the temperature of the body;

and To is the temperature of the external environment.

The invention consists in increasing the surface area S. This makes it possible to increase the mean power of a radiogenic unit, without adding any blowing system to cool the anode.

What is claimed is:

1. A system for cooling a fixed anode for an X-ray tube, working within a radiogenic unit with a metallic wall mounted at one end of a yoke having the shape of an arc of a circle or a U, said fixed anode of said X-ray tube being made out of a copper block into which there is fitted a pellet made of a refractory material with a high atomic number, comprising a cooling circuit in which circulates a cooling fluid that passes into said anode, wherein said cooling circuit is constituted by several tubings made of metal and soldered to said wall of said yoke bearing said radiogenic unit.

2. A system for the cooling of a fixed anode for a single-pole X-ray tube according to claim 1, wherein the fixed anode is connected to said wall of said radiogenic unit and wherein said cooling fluid circulating in the tubings is water.

3. A system for the cooling of a fixed anode for a two-pole X-ray tube according to claim 1, wherein said anode is electrically insulated from said wall of said radiogenic unit and wherein said cooling fluid circulating in the tubings is an electrically insulating oil.

4. A system for the cooling of a fixed anode according to claim 1, wherein said yoke bearing said radiogenic unit has a square section and said tubings of said cooling circuit are four in number and are soldered to an interior of said yoke.

* * * * *